US006305855B1

(12) United States Patent
Bryer et al.

(10) Patent No.: US 6,305,855 B1
(45) Date of Patent: Oct. 23, 2001

(54) INTEGRATED RIBBON MECHANISM

(75) Inventors: Phillip Bryer, Tarzana; Douglas L. Harb, Woodland Hills; Thomas M. Zevin, Conoga Park; Alexander Peter, Van Nuys, all of CA (US)

(73) Assignee: Eltron International, Inc., Camarillo, CA (US)

( * ) Notice: Subject to any disclaimer, the term of this patent is extended or adjusted under 35 U.S.C. 154(b) by 0 days.

(21) Appl. No.: 09/376,199

(22) Filed: Aug. 18, 1999

(51) Int. Cl.[7] ..... B41J 2/325
(52) U.S. Cl. ..... 400/120.16; 400/208; 347/197
(58) Field of Search ..... 347/197, 198; 400/208, 234, 207, 55, 120.16, 120.17

(56) References Cited

U.S. PATENT DOCUMENTS 4,739,344 * 4/1988 Sullivan et al. ..... 347/197
5,128,763 * 7/1992 Sakuragi ..... 347/214
5,284,396 * 2/1994 Masumura et al. ..... 400/234
6,123,471 * 9/2000 Harb et al. ..... 400/248

FOREIGN PATENT DOCUMENTS

94469 * 11/1983 (EP) .
61-179769 * 8/1986 (JP) .
3-180381 * 8/1991 (JP) ..... 347/197
3-268983 * 11/1991 (JP) ..... 347/197
94/02322 * 2/1994 (WO) ..... 347/197

* cited by examiner

*Primary Examiner*—Daniel J. Colilla
(74) *Attorney, Agent, or Firm*—Fulbright & Jaworski L.L.P.

(57) ABSTRACT

An integrated ribbon mechanism comprises a support frame having a bottom plate and two side plates integrated to the bottom plate at opposite sides, a print head assembly rigidly mounted on the bottom surface of a bottom plate, first and second pivotal holes positioned on opposite side plates of the support frame, and a pair of locators positioned at opposite side ends of the print head assembly, each locator having an extrusion portion positioned within a respective slot of the drive mechanism during operation wherein the extrusion portions are smaller than the slots of the drive mechanism to allow the integrated ribbon mechanism to slide against a drive mechanism, the integrated ribbon mechanism being pivotally and adjustably coupled to the drive mechanism by a pair of pivot pins that are smaller than the first and second pivotal holes to allow the integrated ribbon mechanism to slide against the drive mechanism wherein a ribbon strip mounted on the integrated ribbon mechanism will be pulled by a platen of the drive mechanism to align the print head assembly with the platen during operation without losing alignment of the print head assembly with the support frame.

21 Claims, 7 Drawing Sheets

INTEGRATED RIBBON MECHANISM

FIELD OF THE INVENTION

The present invention relates generally to an image forming device, and more particularly to an integrated ribbon mechanism incorporated into a printer for providing an integrated ribbon path to the printer.

BACKGROUND OF THE INVENTION

Many image forming devices, such as printers, available in the market have ribbon mechanisms for providing ribbon strips mounted thereon to be used for forming images on printing mediums passed through the printers. A conventional ribbon mechanism often includes a support frame having a pair of supply spindles respectively mounted on opposite plates (left and right) on the support frame, and a pair of take-up spindles also respectively mounted on opposite plates (left and right) on the support frame. A ribbon roll is mounted on the supply spindles for providing the ribbon strip to a conventional printer. Underneath the support frame, a print head is movably coupled to the bottom of the support frame of the conventional ribbon mechanism by a resilient means, i.e., in a sense, the print head is floating under the support frame of the conventional ribbon mechanism. Normally, the conventional ribbon mechanism is coupled to a drive part of the conventional printer. The drive part is ordinarily positioned under the ribbon mechanism in the conventional printer and is pivotally coupled to the ribbon mechanism by a pivot means. Thus, the conventional ribbon mechanism may be pivotally opened from the drive part for threading the continuous ribbon strip of the ribbon roll between the ribbon mechanism and the drive part.

The ribbon roll is formed by winding and wrapping the continuous ribbon strip over a cylindrically shaped roll holder. To load the ribbon strip in the printer, the roll holder is engaged to the pair of supply spindles at both ends of the ribbon mechanism for holding the ribbon roll. Thereafter, the ribbon strip is pulled from the ribbon roll toward a back end of the conventional ribbon mechanism, behind and underneath the ribbon mechanism to cover the print head, and proceeding upward at a front end of the ribbon mechanism toward a take-up roll holder. The take-up roll holder is mounted on the take-up spindles and is adapted to wind up the ribbon strip to finish loading of the ribbon strip in the conventional printer. As a result, a ribbon path of every conventional printer is defined by the ribbon strip originating from the ribbon roll and ending up at the take-up roll holder via the underside of the conventional ribbon mechanism.

The drive part of the conventional printer contains a platen for pressing the printing medium and the ribbon strip against the print head to facilitate the print head forming images on the printing medium. The platen is of cylindrical shape and the print head often includes a flat panel circuit board capable of converting electrical data to thermal coding information. Normally, the printer has a gear system coupled between the platen and a motor of the printer. The motor is adapted to drive the gear system, which, in turn, rotates the platen at a speed according to gear ratios among gears of the gear system. In addition, the platen presses the printing medium and the ribbon strip against the print head sufficiently tight that when the platen rotates, the printing medium and the ribbon strip will be driven tangentially between the platen and the print head. Thus, the printing medium and the ribbon strip may be moved through the printer by rotating the platen.

As stated, the drive part is pivotally coupled to the ribbon mechanism of the conventional printer. For better alignment between the platen and the print head, the print head is resiliently coupled to the ribbon mechanism. The ribbon mechanism is adapted to be pivotally opened from the drive part for loading or unloading the printing medium, but the ribbon mechanism could not move laterally or vertically with respect to the drive part. The floating arrangement between the print head and the support frame of the ribbon mechanism provides some advantages to the conventional printer. For instance, it allows the print head to be adjustably positioned with respect to the position of the platen. Thus, the floating arrangement of the print head under the support frame provides freedom of motion for better alignment between the print head and the platen.

Normally, the platen is slightly longer than the print head in order not to miss printing of images on the printing medium. It is essential for the platen to press along the print head with even force for producing good quality printouts. Otherwise, any slight misalignment between the print head and the platen might cause the platen to exert uneven force along the print head and might greatly reduce the quality, e.g., the clarity or the sharpness, of images formed on the printing medium. The misalignment might also increase the propensity of wrinkling the ribbon strip and might further degrade the quality of the images formed on the printing medium. In addition, some conventional printers connect the print heads to their respective platens using single brackets within the conventional printers. The single-bracket design of some conventional printers helps reduce possibilities of misalignment for these conventional printers during operation. However, although great efforts have been taken by all printer manufacturers, it is still difficult to precisely align a print head with a platen in a conventional printer during assembly of the printer. Any imperfection, however slight, of aligning the platen with the print head during the printer assembly may potentially cause many adverse effects on printing quality. By having a floating print head design, the requirement for a precise alignment between the platen and the print head during assembly is greatly alleviated. Thus, when the platen presses against the floating print head during operations of the printer, the print head will be forced to readjust its orientation or position relative to the position of the platen for a better alignment. As a result, having a floating print head under the conventional ribbon mechanism will improve the alignment of the print head with the platen during operations, even though the print head and the platen might not be precisely aligned when originally assembled.

The floating print head design of the ribbon mechanism is, however, not without drawbacks to the conventional printer. More particularly, the conventionally designed ribbon mechanism often could not simultaneously align with the print head and the platen, and therefore the ribbon strip mounted on the ribbon mechanism often could not simultaneously align with the ribbon mechanism and the platen during operation as well. That is because most conventional printers' print heads are approximately aligned with their respective ribbon mechanisms when assembled. Therefore, the print head of the conventional printer is usually aligned with the ribbon mechanism only in a loading position, i.e., when the ribbon mechanism is pivotally disengaged from the drive part of the printer and does not touch the platen. For the conventional printer, although the ribbon mechanism is pivotally coupled to the drive part for opening, the support frame of the ribbon mechanism could not adjust its orientation or position relative to the drive part when the ribbon mechanism is closed against the drive part for operation. Normally, the platen is fixedly positioned within the drive part of the conventional printer and will not change its orientation or position with respect to the ribbon mechanism either. As a result, if the print head has to readjust its orientation or position in order to align with the platen, the print head will not be able to maintain sufficient alignment with the conventional ribbon mechanism required for generating acceptable printing quality and ribbon handling.

Moreover, any misalignment between the print head and the ribbon mechanism will potentially cause problems to the ribbon strip. As stated, the ribbon strip is threaded between the print head and the platen. The ribbon path is defined by the ribbon strip originating from the ribbon roll mounted on the supply spindles, proceeding to the underside of the ribbon mechanism at the back end, and moving up at the front end of the ribbon mechanism to be wound by the take-up roll holder mounted on the take-up spindles. If the print head is misaligned with the ribbon mechanism, the ribbon strip will also be forced by the print head to misalign with the ribbon mechanism by virtue of being pressed against the print head by the platen from underneath. When it is misaligned, a part of the ribbon path between the ribbon roll and the print head will therefore be slightly twisted. As a result, a cross section of the ribbon strip that touches the print head during printing could no longer be evenly driven by the platen. Different areas of the misaligned ribbon strip will thus experience unequal net driving forces when moving through the printer and the ribbon strip will therefore experience uneven stress. As a consequence, one end of the misaligned ribbon strip might be pulled with more force than an opposite end of the ribbon strip due to the misalignment. Thus, the uneven stress on the ribbon strip due to misalignment will often result in wrinkles to the ribbon strip and might render poor printing quality to the printing medium. Therefore, an improved ribbon mechanism is needed to provide better and simultaneous alignments for the ribbon strip both with the print head and with the platen.

SUMMARY OF THE INVENTION

An object of the present invention is to provide a mechanism for simultaneously aligning a ribbon path and a print head to a platen of a printer. This object is met by providing an integrated ribbon mechanism wherein a print head assembly is rigidly mounted underneath a ribbon frame of the integrated ribbon mechanism and the whole integrated ribbon mechanism is pivotally floating over a drive mechanism of the printer.

In a preferred embodiment of the present invention, the integrated ribbon mechanism comprises the print head assembly rigidly mounted on an underside of the ribbon frame. A relative position between the print head assembly and the ribbon frame is therefore fixed once assembled and cannot be changed even when being pressed by a platen during operation. As a result, the print head assembly will not be misaligned with the ribbon frame during operation. Moreover, the integrated ribbon mechanism is movably pivoted to the drive mechanism, which comprises the platen fixedly coupled therein, of the printer. Therefore, the whole integrated ribbon mechanism is, in a sense, floating against the drive mechanism, as compared to the conventional printer where the print head alone is floating against the conventional ribbon mechanism. Since the integrated ribbon mechanism is movably coupled to the drive mechanism, the whole integrated ribbon mechanism, including the print head assembly mounted thereon, may adjust its relative position corresponding to a position of the platen during operation of the printer. Moreover, the ribbon strip is adapted to be mounted on the integrated ribbon mechanism and is pressed against the print head assembly by the platen in an operational position. When the integrated ribbon mechanism adjusts its position relative to the drive mechanism, the position of the ribbon strip will follow accordingly. By making the integrated ribbon mechanism floating with respect to the platen, the platen will not cause misalignments to the ribbon strip, or to the printing medium, relative to the integrated ribbon mechanism during operation.

The foregoing and additional features and advantages of this present invention will become apparent by way of non-limitative examples shown in the accompanying drawings and detailed descriptions that follow. In the figures and written descriptions, numerals indicate the various features of the invention, like numerals referring to like features throughout for both the drawing figures and the written description.

BRIEF DESCRIPTION OF THE DRAWINGS

FIG. 6(*b*) shows a side view of a locator according to the present invention.

DETAILED DESCRIPTION OF THE INVENTION

Figure 1:
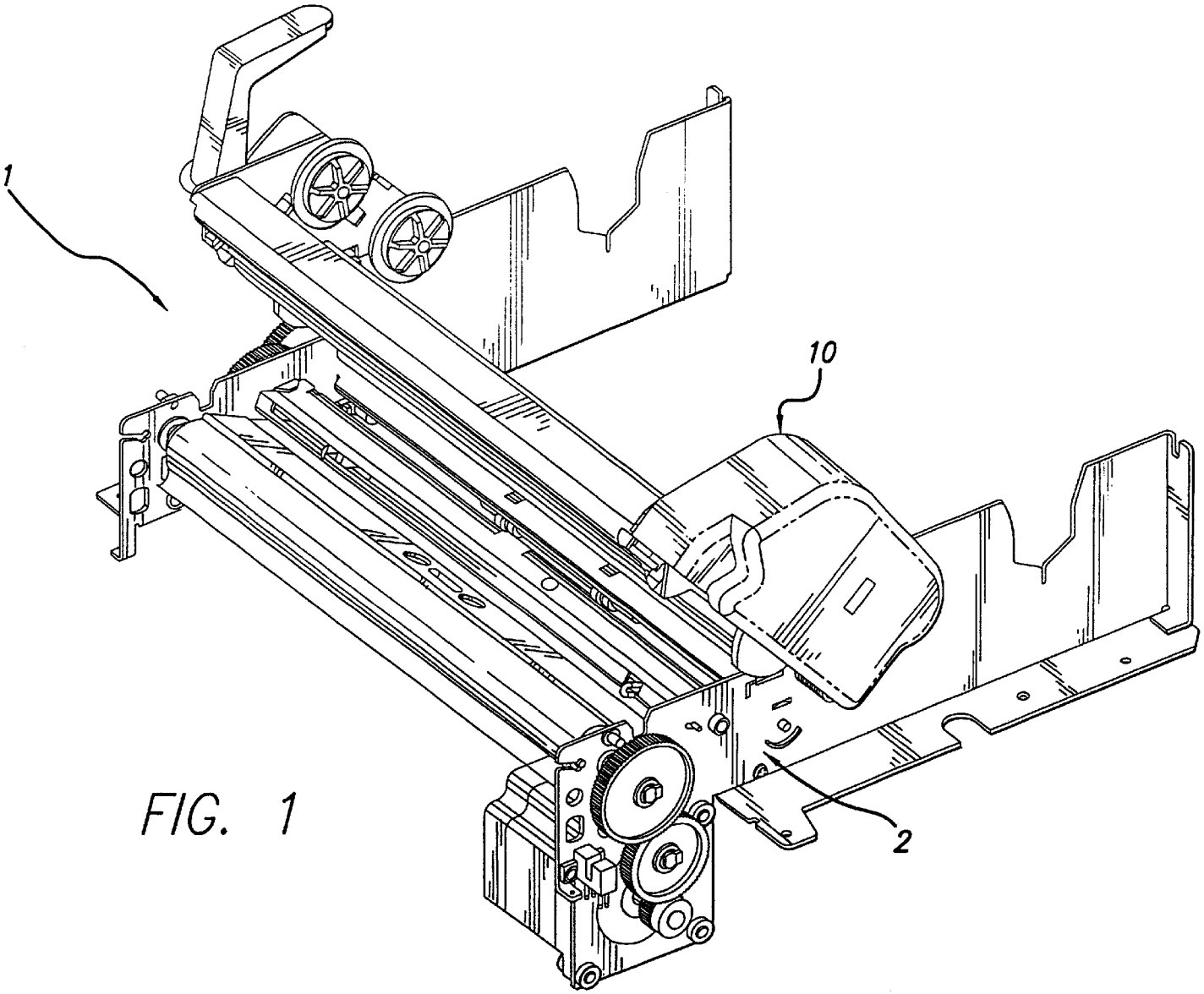
FIG. 1 shows a part of printer comprising an integrated ribbon mechanism coupled to a drive mechanism according to the present invention.
Figure 2:
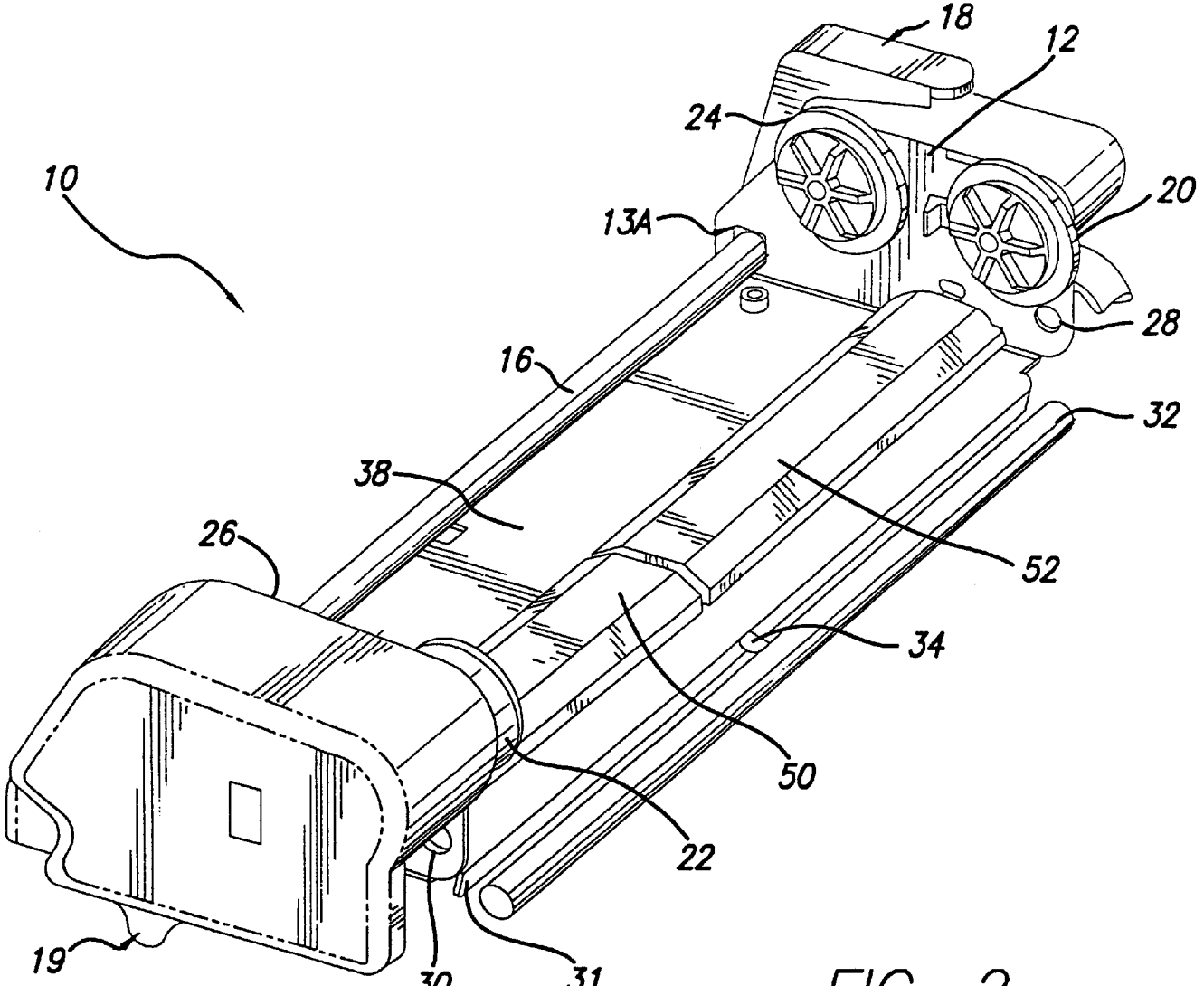
FIG. 2 is an isometric view of the integrated ribbon mechanism of FIG. 1.

FIG. 1 shows a part of a printer 1 comprising an integrated ribbon mechanism 10 coupled to a drive mechanism 2 at a back end. FIG. 2 shows a preferred embodiment of the present invention wherein an integrated ribbon mechanism 10 includes a frame 12. The frame 12 has a bottom plate 38 and has two side plates perpendicularly integrated to the bottom plate 38 at opposite ends (left and right) respectively. A pair of supply spindles 20, 22 are securely mounted on inner sides of the opposite side plates respectively near the back end of the frame 12, and a pair of take-up spindles 24, 26 are also securely mounted on the inner sides of the opposite side plates respectively and are positioned close to a front end of the frame 12. A shaft 16 is threaded through both side plates of the frame 12 through shaft holes 13*a*, 13*b* respectively at the junctures of the side plates and the bottom plate 38 near the front end of the integrated ribbon mechanism 10. A ribbon tracking bar 32 is coupled to a back flange 31, extending from the plate 38 at the back end of the integrated ribbon mechanism 10, through a connecting means 34. The back flange 31 is slightly angled toward the underside of the bottom plate 38 making the ribbon tracking bar 32 positioned slightly lower than the bottom surface of the bottom plate 38 horizontally. In the preferred embodiment, the shaft 16 is approximately 10.75 inches long and the ribbon tracking bar 32 is approximately 9 inches long. Additionally, both the shaft 16 and the ribbon tracking bar 32 are in cylindrical rod shape and respectively have diameters of approximately 0.313 inches. In an alternative embodiment, the ribbon tracking bar 32 may be dispensed with.

A rectangular pressure spring plate (not shown) is positioned between the shaft 16 and the bottom plate 38 for upholding the shaft 16. The pressure spring plate is approximately 6.25 inches long and 0.32 inches wide and is slightly angled up at both ends forming a wide angle V-shape, viewed from the front or back ends of the integrated ribbon mechanism 10, with the center portion of the pressure spring plate coupled to the bottom plate 38. At each end (left or right) of the pressure spring plate, two substantially right-angled rectangular rack protrusions are integrally secured to the pressure spring plate at the front and back ends of the pressure spring plate respectively. The right-angled rack protrusions respectively have a width of approximately 0.12 inches. Each right-angled rack protrusion extends upward and approximately vertical to the pressure spring plate, so that each pair of the rack protrusions at each end of the pressure spring plate forms a U-shape support rack. The two U-shape support racks at both ends of the pressure spring plate are thus approximately vertically positioned with respect to the pressure spring plate for interfacing with the shaft 16. Correspondingly, the shaft 16 has a pair of circular grooves respectively positioned at opposite sides immediately above the pair of U-shape support racks. The circular grooves respectively have a depth of approximately 0.12 inches for housing the rack protrusions. Thus, the pressure spring plate urges the shaft 16 upward against the shaft holes 13*a*, 13*b*. In an alternative embodiment, the pressure spring plate can be inverted or can be replaced by a set of compression springs.

A lever 18 is coupled to a first end of the shaft 16 at the left side, outside of the frame 12, as shown in FIG. 2. The lever 18 has a handle at the top, a cam-shaped contour at the bottom, and a middle part integrally coupled to the lever handle and the cam-shaped bottom. The lever handle is approximately 1.7 inches long and is approximately right-angled from the middle part. The middle part is approximately 2.3 inches long and is coupled to the shaft 16 approximately 0.75 inches from the bottom. Thus, the lever 18 is adapted to rotate the shaft 16 by pulling the lever handle. The lever handle is in a horizontal position when the integrated ribbon mechanism 10 is fully engaged to the drive mechanism 2 for operation. In addition, a cam 19 is rotatably coupled to a second end of the shaft 16 at the right side, outside of the frame 12. The cam 19 corresponds to the cam-shaped bottom of the lever 18 and part of the cam 19 has a similar contour to the cam-shaped bottom of the lever 18. The lever 18, cam 19, and shaft 16 function as both the release and engagement means between the integrated ribbon mechanism 10 and the drive mechanism 2 positioned directly underneath. A user may release the ribbon mechanism 10 from the drive mechanism 2 by pulling the lever handle upward. This pulling action rotates the shaft 16 and it in turn rotates the cam shaped bottom part of the lever 18 and the opposite cam 19 to disengage the integrated ribbon mechanism 10 from the drive mechanism 2. Similarly, pushing down on the lever 18 will rotate the shaft 16, the bottom part of the lever 18, and the opposite cam 19 to engage the integrated ribbon mechanism 10 with the drive mechanism 2. Thus, both the lever 18 and the cam 19 together function to release and engage the integrated ribbon mechanism 10 and the drive mechanism 2 of the printer 1.

Figure 7:
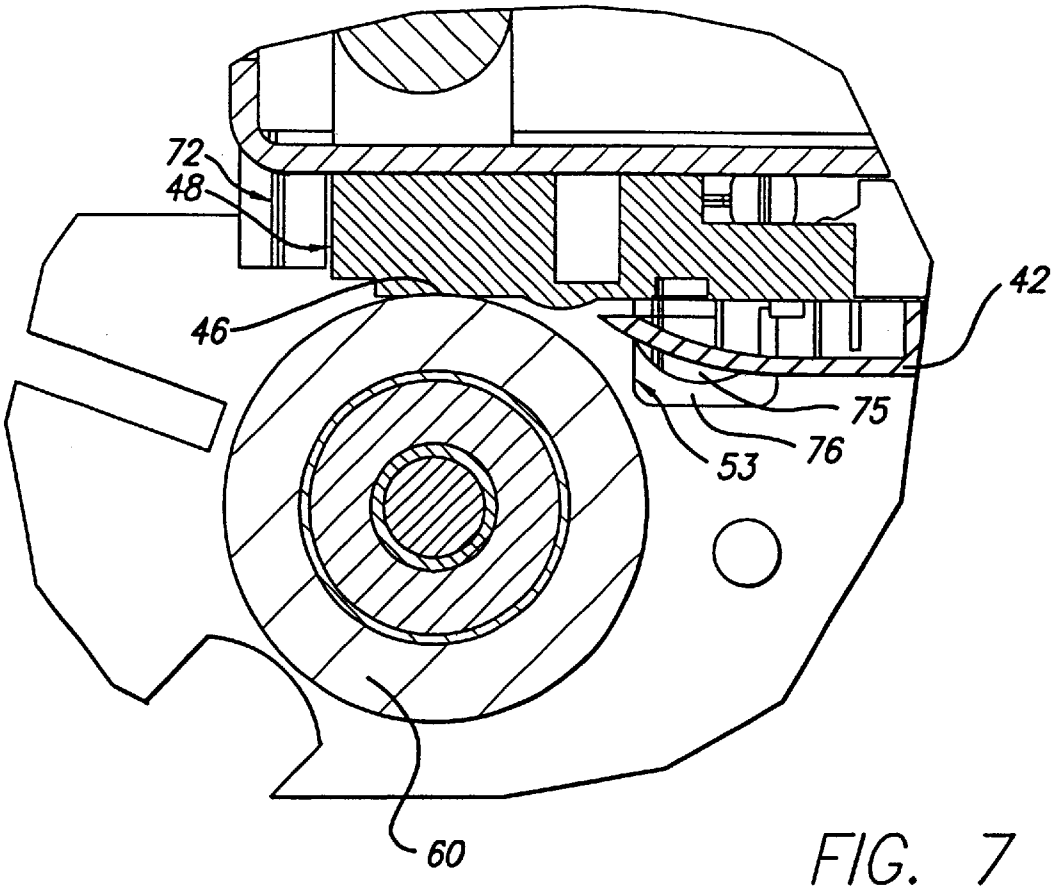
FIG. 7 is a cross-sectional view of the present invention taken along line 5A–5B of FIG. 5 with the integrated ribbon mechanism in an operating position.

The integrated ribbon mechanism 10 is movably pivoted to and is, in a sense, floating over the drive mechanism 2, which will be described in further detail. The integrated ribbon mechanism 10 may be pivotally opened or closed from the drive mechanism 2 as mentioned, and is also free to adjust laterally (back and forth) and vertically with respect to the drive mechanism 2 during operation, as compared to the conventional ribbon mechanism which cannot move laterally or vertically relative to its respective drive part once engaged. During the operation of the printer 1, the integrated ribbon mechanism 10 is engaged to the drive mechanism 2 having a platen 60 (FIG. 7) positioned inside the drive mechanism 2. The platen 60 presses a ribbon strip and a printing medium against a print head assembly 40 positioned at the underside of the frame 12, as shown in FIG. 7. To load the ribbon strip, the user needs to disengage the integrated ribbon mechanism 10 from the drive mechanism 2 by pulling the lever 18.

Figure 3:
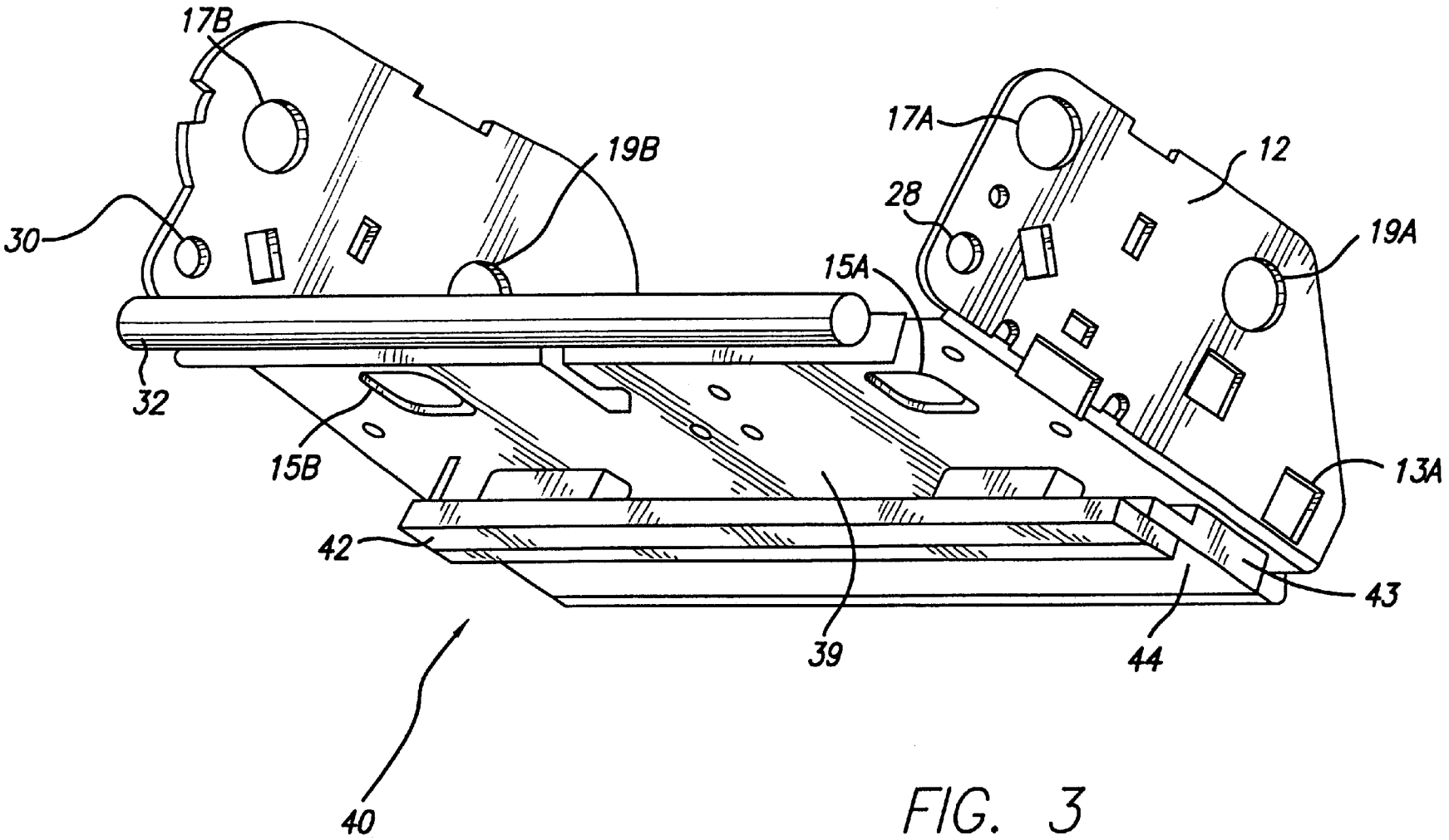
FIG. 3 is a perspective view of a ribbon frame of the integrated ribbon mechanism of FIG. 1 viewed from a lower back side of the ribbon frame.
Figure 5:
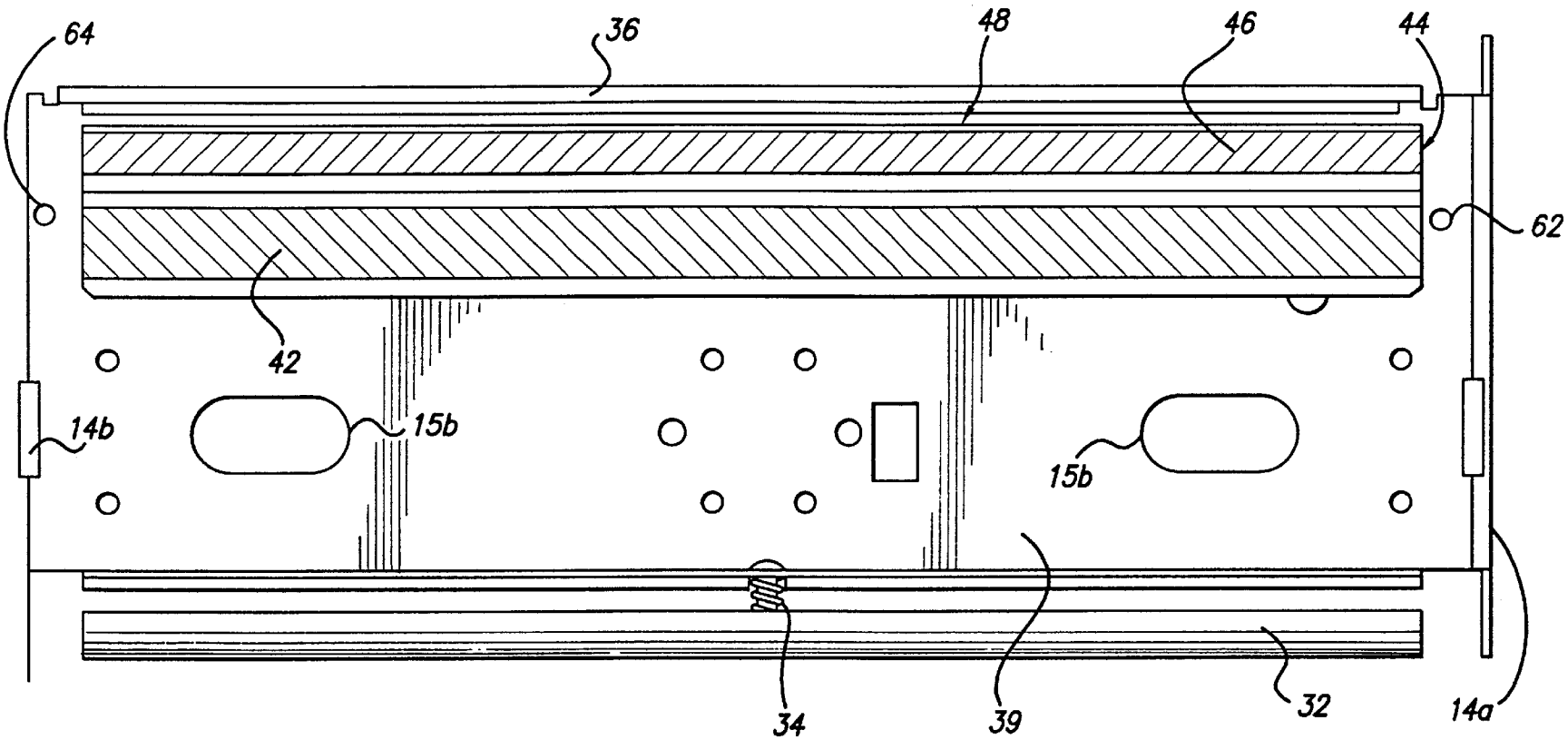
FIG. 5 is a plan view of the bottom of the ribbon frame of the integrated ribbon mechanism of FIG. 1.

Two metal plates 50, 52 are serially disposed on the top surface of the bottom plate 38 approximately underneath and between the pair of supply spindles 20, 22 and the pair of the take-up spindles 24, 26, as shown in FIG. 2. The metal plates 50, 52 are approximately 4.5 inches long, and each has a semi-polygonal shape synergistically functioning as caps to cover one or more sets (normally two sets) of wires (not shown) respectively positioned underneath the metal plates 50,52. In the preferred embodiment, the metal plates 50, 52 are made of aluminum materials, but any other suitable materials may be adopted. The two sets of wires are coupled to the print head assembly 40 by passing through respective holes 15*a*, 15*b* positioned on the bottom plate 38 and underneath the metal plates 50, 52, as shown in FIGS. 3 and 5. Moreover, the two sets of wires come out of the frame 12 respectively through wire holes 14*a*, 14*b* located at the junctures of each side end and the bottom plate 38 next to the metal plates 50, 52. The wire sets are used to transmit electrical information to the print head assembly 40 for directing image printing. In yet another embodiment, the metal plates 50, 52 and the holes 15*a*, 15*b* are replaced by a concave cavity of an extrusion of the bottom plate 38. The extrusion of the bottom plate 38 is covered by a separate plate from the bottom. The extrusion takes the place of the original flat portion of the bottom plate 38, and separate sides 12 are attached to form a similar inversed U-shape assembly.

Figures 8, 9:
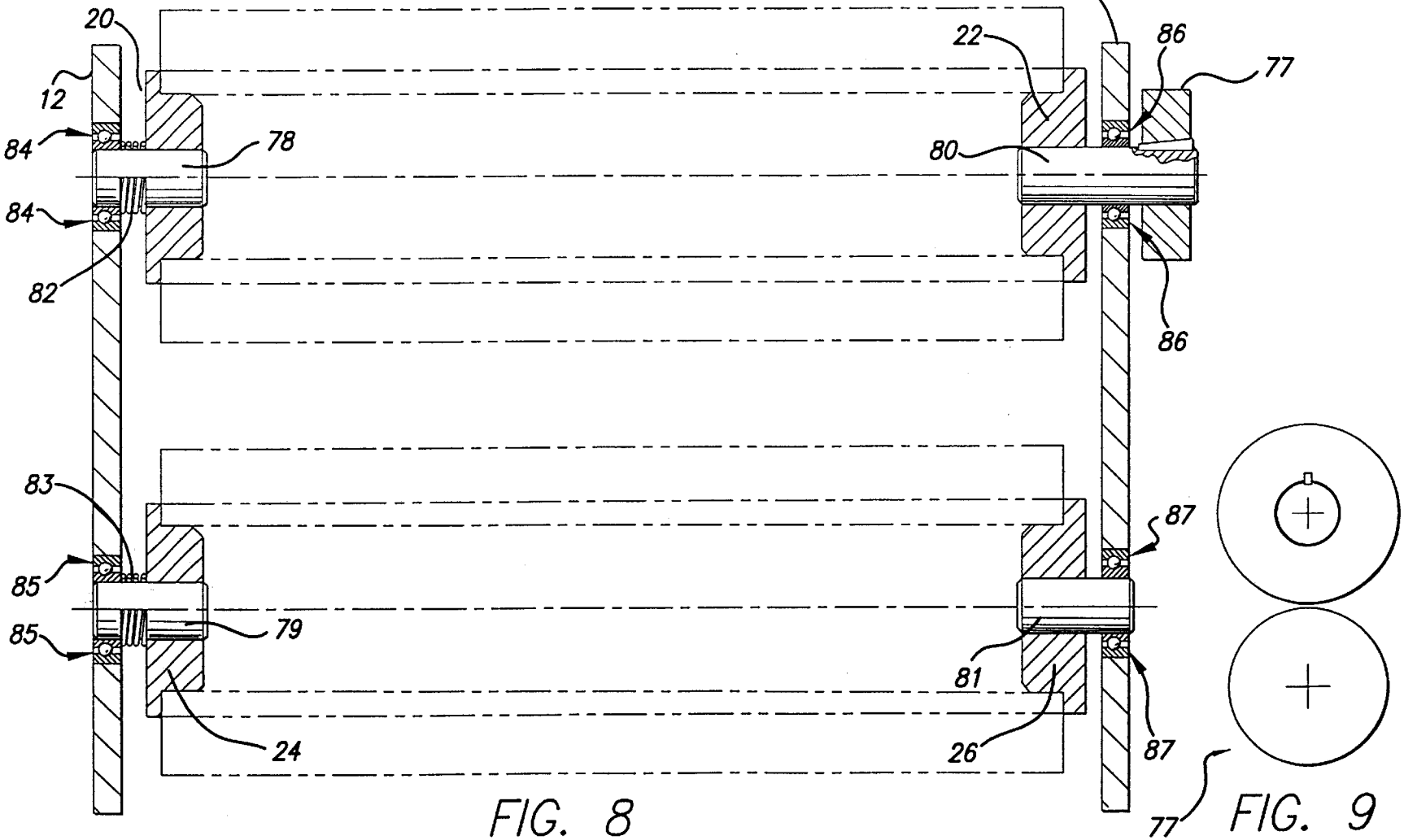
FIG. 8 is a cross-sectional view of the ribbon frame, supply spindles and take-up spindles of the integrated ribbon mechanism of FIG. 1 with mounted support rods thereon shown in elevation for clarity.
FIG. 9 is a vertical elevational view of the clutch and tension mechanism shown as a block schematic in FIG. 8.

The supply spindles 20, 22 serve to hold a ribbon roll (not shown), where the continuous ribbon strip is wrapped over a ribbon roll holder to form the ribbon roll, and the take-up spindles 24, 26 serve to hold a take-up roll (not shown) for winding up the ribbon strip. Each of the four spindles is roundly shaped and has spokes on its surface facing a correspondingly positioned spindle at the opposite side end of the frame 12. The spokes of the spindles prevent rotational slipping of the ribbon roll or the take-up roll with their respective spindles when either roll rotates during operation. FIG. 8 illustrates support rod 78,79 having a length of approximately 1 to 2 inches and a diameter of approximately 0.15 to 0.25 inches is respectively molded into a respective center of the supply spindle 20 or of the take-up spindle 24.

Each support 78,79 rod is effectively welded by a molding process to its respective spindle. In addition, two journal bearings 84,85 are respectively press fit into receptive holes 17*a*, 19*a* of the frame 12 on the left side plate for securing the journal bearings 84,85 on the frame 12. The support rods are also respectively mounted in the journal bearings 84,85 for holding the supply spindle 20 and the take-up spindle 24. The receptive holes 17*a*, 19*a* are of round shape and have a diameter of 0.47 inches respectively. Each of the journal bearings 84,85 has a cylindrical body part and a ring-shape cap part. The body part of the journal bearing 84,85 has a diameter slightly smaller than the diameter of the holes 17*a*, 19*a* to allow the body part of the journal bearing 84,85 to pass through the holes 17*a*, 19*a* The cap part of the journal bearing 84,85 has a diameter slightly larger than the diameter of the holes 17*a*, 19*a* Thus, the cap part of the journal bearing 84,85 prevents the respective journal bearing 84,85 from completely passing free through the holes 17*a*, 19*a* in order to firmly secure the respective journal bearing 84,85 to the left side plate of the frame 12. Moreover, the journal bearings 84,85 respectively have a cylindrical channel allowing the respective support rod to pass through its journal bearing 84,85 for supporting the respective supply spindle 20 or the take-up spindle 24. The diameter of the cylindrical channel of the journal bearing 84,85 is slightly larger than the diameter of the support rod 78,79, so that the support rod 78,79, and thus the support spindle and the take-up spindle, may freely rotate. Likewise, the supply spindle 22 and the take-up spindle 26 are supported by respective support rods 80,81 and/or journal bearings 86,87 in a similar manner on the right side plate of the frame 12. In the preferred embodiment, the support rods 78,79 of the supply spindle 20 and the take-up spindle 24 are encircled by coil springs 82,83 constrained between the respective spindles 20,24 and the left side plate of the frame 12. The coil springs 82,83 push the supply spindle 20 and the take-up spindle 24 toward the center of the frame 12 and are adapted to be compressed leftward along the respective support rods 78,79 to enable the loading or unloading of the ribbon roll or the take-up roll.

To install the ribbon strip, the ribbon roll is first mounted on the supply spindles 20, 22, and the ribbon strip of the ribbon roll is pulled backward toward the back end of the frame 12 for partially wrapping around the ribbon tracking bar 32, if any. Ordinarily, the ribbon strip is unwound from the ribbon roll over the top of the ribbon roll, and the ribbon roll will accordingly rotate (clockwise viewed from the right side plate) when the ribbon strip is pulled backward. The ribbon strip proceeds to pass underneath the frame 12, to move up at the front end of the frame 12, and then to circle and wind on the take-up roll near the front end of the frame 12. A ribbon path within the printer 1 is therefore defined by the ribbon strip originating from the ribbon roll, which is mounted on the supply spindles 20, 22, and ending at the take-up roll, which is mounted on the take-up spindles 24, 26, around the underside of the integrated ribbon mechanism 10. In the preferred embodiment, a clutch and tension mechanism 77 (FIGS. 8 and 9) is coupled to the support rod 80 of the supply spindle 22 at the outer side of the right side plate of the frame 12. The clutch and tension mechanism 77 resists the rotation of the supply spindles 22. Thus, the clutch and tension mechanism 77 imparts tension to the ribbon strip, to help straighten out the ribbon strip along supply spindles 20, 22 or the take-up spindles 24, 26 for holding the ribbon roll or the take-up roll. In a further alternative embodiment, the supply shaft or the take-up shaft may each have a tension mechanism built therein to impart tension to the ribbon strip for straightening out the ribbon strip, similar to the function of the clutch and tension mechanism. In yet another alternative embodiment, one or more clutch and tension mechanisms may be incorporated to the supply spindles or the take-up spindles for providing tension to the ribbon strip in order to straighten out and prevent wrinkles of the ribbon strip.

FIG. 3 shows a perspective view of the frame 12 viewed from the lower back end. As can be seen in FIG. 3, the print head assembly 40 is rigidly mounted on a bottom surface 39 underneath the frame 12 of the integrated ribbon mechanism 10. The print head assembly 40 includes a print head PCB (printed circuit board) 44, also shown in FIG. 4, for forming images on the printing medium. The platen 60 presses the ribbon strip and the printing medium against the print head PCB 44 during operation and is disengaged from the integrated ribbon mechanism 10 in a loading position by pulling the lever 18 as stated above.

Figure 4:
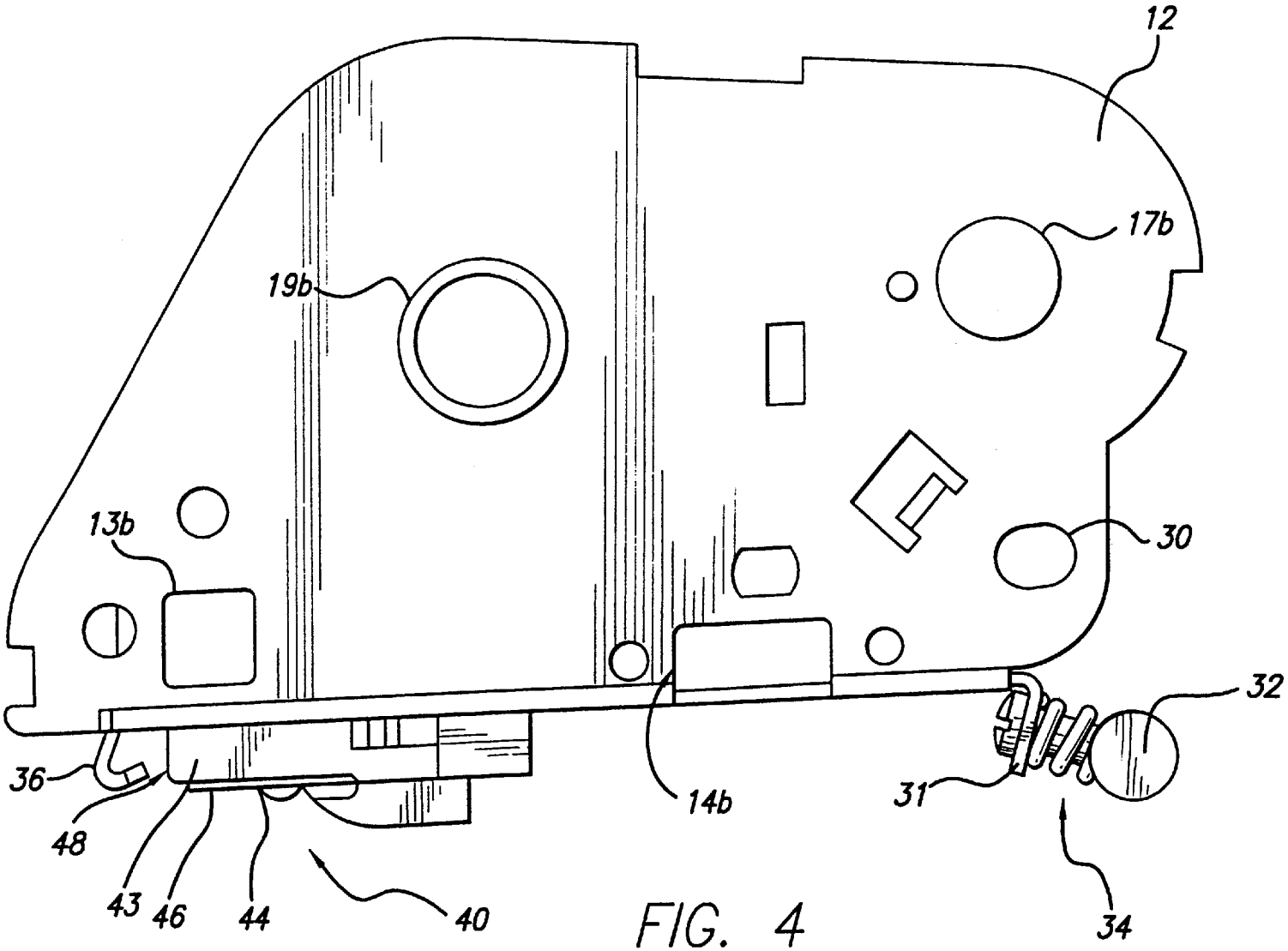
FIG. 4 is a side elevational view of the ribbon frame of the integrated ribbon mechanism of FIG. 1.

FIG. 4 shows a side view of the frame 12 having the print head assembly 40 and the ribbon tracking bar 32 mounted thereon. As shown, the print head assembly 40 is rigidly mounted underneath and near the front end of the frame 12. Unlike the conventional printers, the present invention provides no resilient mechanism used to couple the print head assembly 40 to the frame 12 of the integrated ribbon mechanism 10. In the preferred embodiment, the print head assembly 40 comprises a metal plate 43, which may also function as a heat sink for the print head assembly 40. The metal plate 43 is rigidly mounted on the bottom surface 39 of the frame 12 near the front end of the integrated ribbon mechanism 10. The metal plate 43, similar to the print head assembly 40, is rectangularly shaped and is approximately 9 inches long, which is slightly shorter than the overall length of the bottom plate 38 of the frame 12. In the preferred embodiment, the metal plate 43 is made of aluminum to provide good heat dissipation ability. However, any other materials suitable to function as a heat sink may also be properly adopted by persons skilled in the art.

As mentioned, the rectangularly shaped print head PCB 44 is securely mounted on the surface of the metal plate 43. A plastic cover 42 is subsequently mounted on the print head assembly 40 and partially covers the print head PCB 44. The plastic cover 42 is also of rectangular shape, but it has an uneven thickness between its front end and its back end. The plastic cover 42 has a thickness of approximately 0.12 inches at the back end, and it gradually thins out from about the middle part of the plastic cover 42 to the front end of the plastic cover 42. As a result, the plastic cover 42 has a relatively sharp edge at the front end. The print head PCB 44 is coupled to the two wire sets for receiving electrical information and has a thermal line section 46 (not covered by the plastic cover 42) for converting the electrical information into thermal coding information. During the operation, the platen 60 presses the printing medium and the ribbon strip against the thermal line section 46 of the print head PCB 44 (FIG. 7) for receiving the thermal coding information. Thus, the thermal line section 46 will cause the ribbon strip to form images on the printing medium according to the thermal coding information. FIG. 4 further shows a ribbon guide rail 36 positioned on the frame 12 at the front end of the bottom plate 38 for smoothly guiding the ribbon strip back up to the take-up roll. In the preferred embodiment, the ribbon guide rail 36 is a metal flange positioned along the front end of the frame 12, as shown in FIGS. 4 and 5, for the ribbon strip to slide over. The guide rail 36 has a depending part integrally coupled to the bottom plate 38 of the frame 12 and extending frontward and parallel to the surface plane of the bottom plate 38, a slanting part integrally coupled to the depending part and bending downward with an angle of less than 90° with respect to the depending part, and a retracting part integrally coupled to the slanting part and bending backward toward the back end of the frame 12 with an angle of more than 90° with respect to the slanting part. Thus, the slanting part of the guide rail 36 forms a slope inclined toward the frame 12 to allow the ribbon strip to smoothly glide it over. In another embodiment, the guide rail 36 is replaced by a bulge in the cross section of a front extrusion of the bottom plate 38.

A bottom view of the frame 12 with the print head assembly 40 and the ribbon tracking bar 32 coupled to the frame 12 is shown in FIG. 5. In FIGS. 4 and 5, the metal plate 43 has a front edge 48 near the ribbon guide rail 36. As will be elaborated further, the whole integrated ribbon mechanism 10 is floating against the drive mechanism 2, and the front edge 48 of the metal plate 43 may be used to measure how far the whole integrated ribbon mechanism 10 may be laterally moved, i.e., back or forth, in the printer 1 relative to the drive mechanism 2.

Figure 6A:
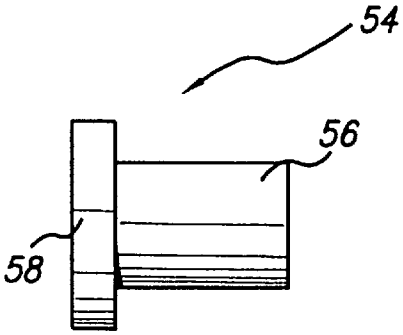
FIG. 6(*a*) is a pivot pin according to the present invention.
Figure 6B:
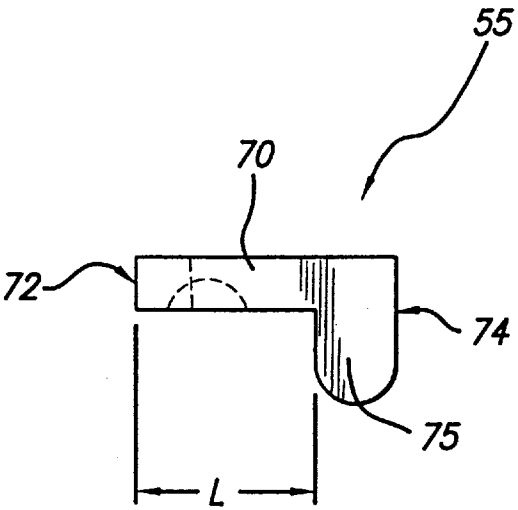

The frame 12 has first and second pivoting holes 28 and 30 respectively positioned on the side plates approximately under the supply spindles 20 and 22, as shown in FIGS. 2, 3. Both pivoting holes 28, 30 are of elliptic shape approximately 0.277 inches long and 0.217 inches wide. FIG. 6(*a*) shows a pivot pin 54 of stepped cylindrical shape constituting first and second sections 56 and 58 respectively. The first section 56 of the pivot pin 54 has a diameter of approximately 0.213 inches and a length of approximately 0.3 inches. The overall length of the pivot pin 54 is approximately 0.33 inches long. The diameter of the first section 56 is smaller than the diameter of the second section 58, which is approximately 0.38 inches. The diameter of the first section 56 is also slightly smaller than the width of the first hole 28 and of the second hole 30, but the diameter of the second section 58 is larger than the width respectively of the first and second holes 28, 30 of the frame 12. Thus, the first section 56 of the pivot pin 54 may be movably inserted into the first or second holes 28, 30 to allow the pivot pin 54 to slide laterally, or even slightly vertically, within the first or second holes 28, 30.

Further, two pin holes (not shown) are respectively positioned on opposite sides (left and right) of the drive mechanism 2. Positions of the pin holes are properly located in the drive mechanism 2, corresponding to the first and second holes 28, 30 of the frame 12 when mounted thereon. Thus, each pin hole will approximately align with its respective first or second holes 28, 30 when the integrated ribbon mechanism 10 is assembled to the drive mechanism 2. As compared to the elliptic holes 28, 30, both pin holes of the drive mechanism 2 are approximately roundly shaped and allow threaded fasteners to fix the pivot pins 54 to the sides of the drive mechanism 2. A pair of the pivot pins 54 are thus adapted to movably and pivotally couple the integrated ribbon mechanism 10 to the drive mechanism 2 by threading the pivot pins 54 through the respective pin holes of the drive mechanism 2 and through the first and second holes 28, 30 of the frame 12. Since the first section 56 of the pivot pin 54 may slide laterally and slightly vertically within the first and second holes 28, 30 of the frame 12, the pair of pivot pins 54 allow the integrated ribbon mechanism 10 to be movably pivoted to the drive mechanism 2 after being mounted thereon. Therefore, the whole integrated ribbon mechanism 10 is, in a sense, adjustably floating against the drive mechanism 2, as compared to the conventional printer where only the print head is floating against the ribbon mechanism.

FIG. 7 shows a cross-sectional view (looking from the cutting line 5A–5B in FIG. 5 with the print head assembly 40 bearing down against the platen 60) of the integrated ribbon mechanism 10 in the operational position, wherein the thermal line section 46 of the print head PCB 44 is pressed against the platen 60. Referring to FIG. 6(*b*), a pair of locators 55 are employed for properly positioning the integrated ribbon mechanism 10 relative to the drive mechanism 2 during operation. Each locator 55 has a vertical extrusion portion 75, of approximately 0.2 inches length vertically, and a front extending section 70, of approximately 0.53 inches length laterally (length L). A pair of fixing means, such as screws, are used to couple the pair of locators 55 to the frame 12 by using tapped holes in the extrusion portions 75 and mounting through respective locator holes 62, 64 of the frame 12 (FIG. 5). When the locators 55 are mounted on the integrated ribbon mechanism 10, the vertical length of the front extending section 70 should not extend beyond the print head PCB 44 so that the locators 55 do not touch the platen 60 during operation. As a result, viewed from the line 5A–5B of FIG. 5, parts of the locator 55 are blocked by the print head assembly 40 and cannot be seen.

Once the locator 55 is mounted on the frame 12, a front extending edge 72 of the locator 55 extends beyond the print head assembly 40 at the front end, but not beyond the front edge of the ribbon guide 36. When closed for the operational position, the extrusion portions 75 of both locators 55 are positioned within a pair of slots 76, as shown in FIG. 7, respectively located on both side ends of the drive mechanism 2. Each slot 76 has a lateral width of approximately 0.256 inches long and 0.26 inches deep so as to sufficiently receive the extrusion portion 75 of the locator 55. The lateral width of the extrusion portion 75 is smaller than the lateral width of the slot 76 to allow the extrusion portion 75 to slide laterally (back and forth) within the respective slot 76. By positioning the extrusion portions 75 of the locators 55 within the respective receptive slots 76 of the drive mechanism 2, the integrated ribbon mechanism 10 may move laterally (back and forth) with respect to the drive mechanism 2. Furthermore, as already mentioned, the integrated ribbon mechanism 10 is also movably pivoted to the drive mechanism 2. Thus, the whole integrated ribbon mechanism 10 is movably adjustable with respect to the drive mechanism 2 at both the operation position and the loading position.

Since the locators 55 are securely mounted on the integrated ribbon mechanism 10, by carefully positioning the locators 55 relative to the print head assembly 40, a manufacturer of the printer 1 may determine how much lateral movement, i.e., forward and backward, the integrated ribbon mechanism 10 is allowed. As stated, when the integrated ribbon mechanism 10 is closed for operation, the extrusion portions 75 of the locators 55 will be positioned within respective slots 76, allowing the integrated ribbon mechanism 10 to slide back and forth with respect to the drive mechanism 2. Furthermore, the slots 76 are properly positioned in the drive mechanism 2 such that the extrusion portions 75 of the locators 55 will always be positioned within the slots 76 during the operation position. The overall length of the locator 55 is measured from the front extending edge 72 to a back edge 74. A manufacturer of the printer could therefore adjust relative front edge positions between the front extending edge 72 of the locators 55 and the front edge 48 of the metal plate 43 by adjusting distance L, which is approximately 0.65 inches, as shown in FIG. 6(*b*). By choosing how far the front edge 72 extends over the front edge 48 of the metal plate 43, as long as the extrusion portions 75 will still fall within the respective slots 76 when closed, the manufacturer may determine the lateral movement (back and forth) of the integrated ribbon mechanism 10 relative to the drive mechanism 2 during operation.

During operation, the platen 60 presses the printing medium and the ribbon strip against the thermal line section 46 of the print head assembly 40. A gearing mechanism is (shown in FIG. 1) is coupled to the platen 60 for rotating the same in order to move the printing medium and the ribbon strip through the printer 1. Alternatively, the gear mechanism may also be coupled to the take-up spindle 26 for rotating the take up spindle 26 and for pulling the ribbon strip from the ribbon roll to the take-up roll. The gearing mechanism may be controlled by a motor of the printer 1, as shown in FIG. 1.

As stated, the integrated ribbon mechanism 10 is adjustably floating against the drive mechanism 2. When the platen 60 rotates to pull the ribbon strip forward, the whole integrated ribbon mechanism 10 will be pulled slightly forward until the extrusion portions 75 of the locators 55 touch front walls of the respective slots 76. By carefully positioning the locators 55 on the integrated ribbon mechanism 10, the thermal line section 46 of the print head PCB 44 can be assuredly aligned with the platen 60 during operation. Since the integrated ribbon mechanism 10 is floating over the drive mechanism 2, the orientation of the print head assembly 40 will also be adjusted to evenly align with the platen 60 due to the pressure from the platen 60 during operation. In addition, the print head assembly 40 is rigidly mounted on the ribbon frame 12 and cannot be tilted with respect to the integrated ribbon mechanism 10. Thus, the print head assembly 40 will always remain aligned with the ribbon frame 12 of the integrated ribbon mechanism 10. Furthermore, the whole integrated ribbon mechanism 10 will tilt, if necessary, in response to the pressure from the platen 60. The ribbon path will, therefore, not be misaligned with the print head assembly 40 because no misalignment will occur between the print head assembly 40 and the ribbon frame 12 when the ribbon path is pressed against the print head assembly 40, whereas many conventional printers experience misalignments because the conventional printers' ribbon paths cannot simultaneously align to both their print heads and their platens. Therefore, the ribbon path will simultaneously be aligned with the platen 60 and the print head assembly 40 according to the present invention.

The floating arrangement of the whole integrated ribbon mechanism 10 with respect to the drive mechanism 2 provides the benefits associated with the floating print head configuration commonly adopted by the conventional printers. Namely, the present invention alleviates the possibility of misalignment between the print head assembly 40 and the platen 60. In addition, the present invention further reduces the likelihood of ribbon strip wrinkles that frequently occur in conventional printers due to misalignment between their print heads and their ribbon frames. As a result, the present invention provides the benefits of the conventional printers while, at the same time, prevents the above-mentioned problems often encountered by the conventional printers.

From the foregoing, it will be appreciated that, although specific embodiments of the invention have been described herein for purposes of illustration, various modifications may be made by persons skilled in the art without deviating from the spirit and/or scope of the invention. For example, the sizes and dimensions of the first and second holes 28 and 30 and the size of the pivot pins 54 may be changed respectively to provide desirable slidable movement. The overall length of the locators 55 may also be modified to provide desirable lateral movements of the integrated ribbon mechanism 10. A person skilled in the art may choose a suitable print head assembly among various ones commercially available from multiple manufacturers. And the relative sizes and dimensions of various parts of the integrated ribbon mechanism 10 may also be adjusted to fit into different size printers according to the present invention.

What is claimed is:

1. A device adapted to be movably coupled to an image forming machine, the device comprising:

a support frame, said support frame having a bottom plate and first and second side plates coupled to the bottom plate at opposite sides;

a print head assembly rigidly coupled to an underside of the support frame;

ribbon means coupled to the support frame; and adjustment means adapted to move the support frame in at least two directions, the first direction being in a plane of the bottom plate to allow the support frame to move between front and back positions, and the second direction being about a vertical axis perpendicular to the plane.

2. The device of claim 1, wherein the adjustment means comprise first and second pivoting holes correspondingly positioned on respective first and second side plates near a back end of said support frame, said pair of pivoting holes respectively having a predetermined size and shape and being adapted to mount a pivoting pin respectively for pivotally and adjustably coupling the device to an image forming machine.

3. The device of claim 2 wherein said first and second pivoting holes are of elliptic shape.

4. The device of claim 1, the ribbon means comprising:

a ribbon supply mechanism, said ribbon supply mechanism being coupled to said support frame at the first and second side plates near a back end, said ribbon supply mechanism being adapted to hold a ribbon roll; and a ribbon take-up mechanism, said ribbon take-up mechanism being coupled to said support frame at the first and second side plates near a front end, said ribbon take-up mechanism being adapted to hold a ribbon take-up roll.

5. The device of claim 4, wherein said ribbon supply mechanism comprises:

first and second supply spindles, said first and second supply spindles respectively being in round shape and having a plurality of spokes on each face of supply spindle;

first and second journal bearings securely coupled to the respective first and second side plates of said support frame;

first and second support rods respectively coupled to said first and second supply spindles, said first and second support rods being respectively inserted through said first and second journal bearings for supporting said first and second supply spindles respectively; and a spring means coupled to the ribbon supply mechanism between said first supply spindle and said first journal bearing, said spring means being adapted to allow said first supply spindle to be in compression when moved toward said first journal bearing.

6. The device of claim 5, wherein said spring means comprises a first coiling spring, said first coiling spring encircling said first support rod between said first supply spindle and said first journal bearing.

7. The device of claim 5, wherein said ribbon supply mechanism further comprises a clutch and tension mechanism coupled to said second supply spindle through said second support rod, said clutch and tension mechanism being adapted to provide controlled resistence to the rotation of said second supply spindle at a first rotational direction.

8. The device of claim 4, wherein said ribbon take-up mechanism comprises:

first and second take-up spindles, said first and second take-up spindles respectively being in round shape and having a plurality of spokes on each face of the take-up spindle;

first and second journal bearings securely coupled to the respective first and second side plates of said support frame;

first and second support rods respectively coupled to said first and second take-up spindles, said first and second support rods being respectively inserted through said first and second journal bearings for supporting said first and second take-up spindles respectively; and a spring means coupled to said ribbon take-up mechanism between said first and second take-up spindles and said first journal bearing, said spring means being adapted to allow said first take-up spindle to be in compression when moved toward said first journal bearing.

9. The device of claim 8, wherein said spring means comprises a coiling spring, said coiling spring encircling said first support rod between said first take-up spindle and said first journal bearing.

10. The device of claim 8, wherein said ribbon take-up mechanism further comprises a gearing mechanism coupled to said second take-up spindle through said second support rod, said gearing mechanism being adapted to rotate said second take-up spindle.

11. The device of claim 4, wherein said ribbon supply mechanism comprises a ribbon supply shaft coupled to the first and second side plates of said frame near the back end.

12. The device of claim 11, wherein said ribbon supply shaft comprises a tension mechanism for resisting rotation of said ribbon supply shaft in a first rotational direction.

13. The device of claim 4, wherein said ribbon take-up mechanism comprises a ribbon take-up shaft coupled to first and second side plates of said support frame.

14. The device of claim 1, further comprising a lever mechanism coupled to said support frame at a front end for urging the device to pivotally engage with and to disengage from a drive part of the image forming machine.

15. The device of claim 14, wherein said lever mechanism comprises:

a cam shaft, said cam shaft being rotatably inserted through the first and second side plates of said support frame;

a lever securely coupled to said cam shaft at a first end outside of said support frame, said lever having a lever handle at the top and a cam-shape contour at the bottom; and a cam securely coupled to said cam shaft at a second end, opposite to the first, outside of said support frame, wherein said lever being adapted to rotate said cam shaft and said cam to urge the device to pivotally engage with and disengage from the drive part of the image forming machine.

16. The device of claim 1, further comprising locating means coupled to the support frame and being adapted to detect horizontal movement of the device with respect to an image forming machine when the device is engaged with an image forming machine.

17. The device of claim 16, wherein an image forming machine has side slots, the locating means comprising first and second locators securely coupled to said support frame at opposite ends of said print head assembly respectively, each locator respectively having a downward protrusion adapted to be positioned within respective side slots of an image forming machine, respective side slots being dimensionally larger than the downward protrusions of each locator allowing each locator, and the device, to be movably adjustable with respect to an image forming machine.

18. The device of claim 1, wherein said print head assembly comprises:

a metal plate securely coupled to said support frame at the underside;

a print head board securely coupled to said metal plate, said print head board having a thermal line section adapted to form images on a printable medium; and a cover, said cover partially covering said print head board but not the thermal line section of said print head board.

19. The device of claim 18, wherein said metal plate is made from aluminum or other heat conducting materials and is adapted to dissipate heat generated by the print head assembly.

20. The device of claim 1, further comprising means for the support frame to move between up and down positions within the plane with respect to an image forming machine.

21. The device of claim 20, the means for the support frame to move between up and down positions within the plane with respect to an image forming machine comprising:

a shaft coupled to each side plate of the support frame by being inserted into at least one hole in each side of the support frame at a front end;

each hole in the side plate being dimensionally larger than the shaft; and a pressure spring plate coupled to the support frame, the pressure spring plate being adapted to move the shaft and the device vertically with respect to an image forming machine.

* * * * *